US006209232B1

(12) United States Patent
Ono et al.

(10) Patent No.: US 6,209,232 B1
(45) Date of Patent: Apr. 3, 2001

(54) CONSTRUCTION MACHINE WITH FUNCTION OF MEASURING FINISHING ACCURACY OF FLOOR FACE SMOOTHED THEREBY

(75) Inventors: Tomoaki Ono; Shoji Tozawa, both of Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 0 days.

(21) Appl. No.: 09/051,514

(22) PCT Filed: Mar. 14, 1997

(86) PCT No.: PCT/JP97/00819

§ 371 Date: Apr. 10, 1998

§ 102(e) Date: Apr. 10, 1998

(87) PCT Pub. No.: WO98/10147

PCT Pub. Date: Mar. 12, 1998

(30) Foreign Application Priority Data

Sep. 4, 1996 (JP) ..... 8-234525

(51) Int. Cl.[7] ..... G05D 1/04
(52) U.S. Cl. ..... 37/348; 701/50
(58) Field of Search ..... 37/348, 382, 195; 414/699, 694; 701/50; 356/3.01, 400, 141.1

(56) References Cited

U.S. PATENT DOCUMENTS 4,129,224 * 12/1978 Teach ..... 214/763
4,829,418 * 5/1989 Nielsen et al. ..... 364/167.01
4,888,890 * 12/1989 Studebaker et al. ..... 37/103
5,682,311 * 10/1997 Clark ..... 364/424.07
5,701,691 * 12/1997 Watanabe et al. ..... 37/348
5,848,485 * 12/1998 Anderson et al. ..... 37/348

FOREIGN PATENT DOCUMENTS 3-295933 12/1991 (JP) .
3-295934 12/1991 (JP) .
3-295935 12/1991 (JP) .
4-161525 6/1992 (JP) .
4-106229 8/1992 (JP) .
6-146334 5/1994 (JP) .
7-216930 8/1995 (JP) .

* cited by examiner

*Primary Examiner*—Victor Batson

(57) ABSTRACT

A construction machine (10) with a laser measuring instrument which includes a construction machine body, a working apparatus, and a manually operable member for driving a cylinder apparatus of the working apparatus to operate a plurality of arm members and an end working member is constructed such that it comprises an array type laser receiver (114) mounted on the arm member positioned on the free end side for receiving a laser beam parallel to an aimed floor face irradiated from a laser apparatus (120) disposed at a position spaced away from the construction machine (10): posture detection structure (3-1 to 3-3, 4) for detecting a posture of the construction machine, and control structure (2) for controlling the working apparatus based on a result of detection by the posture detection structure (3-1 to 3-3, 4) so that the array type laser receiver (114) may receive the laser beam from the laser apparatus (120) at a predetermined angle. Consequently, the working member can be driven automatically and accurately so that the laser beam may be received at the right angle.

2 Claims, 11 Drawing Sheets

CONSTRUCTION MACHINE WITH FUNCTION OF MEASURING FINISHING ACCURACY OF FLOOR FACE SMOOTHED THEREBY

TECHNICAL FIELD

This invention relates to a construction machine with a laser measuring instrument, and more particularly to a construction machine with a laser measuring instrument suitable for use for measurement of a finished floor face.

BACKGROUND ART

Conventionally, as shown in FIG. 8. a construction machine (working machine) 115 such as a hydraulic excavator includes a lower traveling member 100 including a right track 100R and a left track 100L which can be driven independently of each other, and a working machine body section (working machine body) 102 with an operator cab 101 mounted for rotation in a horizontal plane on the lower traveling member 100. Further, a boom 103 is mounted for pivotal motion in a vertical direction on the working machine body section 102, and a stick 104 is mounted for pivotal motion similarly in a vertical direction on the boom 103.

A pair of boom driving hydraulic cylinder apparatus (liquid pressure cylinder apparatus) 105 (only one is shown in FIG. 8) for driving the boom 103 are provided in a juxtaposed relationship between the working machine body section 102 and the boom 103, and a stick driving hydraulic cylinder apparatus (liquid pressure cylinder apparatus) 106 for driving the stick 104 is provided between the boom 103 and the stick 104.

It is to be noted that a bucket 108 which is driven by a hydraulic cylinder apparatus 107 is removably mounted at an end of the stick 104.

Further, the left track 100L and the right track 100R mentioned above include traveling motors 109L and 109R (refer to FIG. 10) serving as power sources independent of each other, respectively, and a revolving movement by the working machine body section 102, a pivotal movement by the boom 103 and the stick 104 and driving of the bucket 108 are operated under the control of a hydraulic control circuit apparatus 111 hereinafter described with reference to FIG. 10 as a hydraulic pump is driven by an engine (internal combustion engine) not shown.

By the way, the operator cab 101 is constructed in such a manner as shown, for example, in FIG. 9. The operator cab 101 includes a seat 101A on which an operator is to be seated, a left lever 101B, a right lever 101C, a console 101D, a left pedal 101L, a right pedal 101R, an instrument panel 101E and a safety lock lever 101F.

Here, the left lever 101B, right lever 101C, left pedal 101L and right pedal 101R mentioned above are provided to control movements of the working machine 115 (traveling, revolving movement, pivotal movement of the boom, pivotal movement of the stick or pivotal movement of the bucket).

For example, if an operator manually operates the left and right levers 101B and 101C forwardly or rearwardly and leftwardly or rightwardly, then the hydraulic cylinder apparatus 105 to 110 are driven under the control of the hydraulic control circuit apparatus 111 so that a revolving movement, a pivotal movement of the boom, a pivotal movement of the stick or a pivotal movement of the bucket can be performed.

In the meantime, if the left pedal 101L is treadled down, then the amount of the treadling movement is transmitted to the left side traveling motor 109L via the hydraulic control circuit apparatus 111 to drive the left track 100L to rotate, but if the right pedal 101R is treadled down, then the amount of the treadling movement is transmitted to the right track 100R via the hydraulic control circuit apparatus 111 to drive the right track 100R to rotate so that the working machine 115 can travel (travel straightforwardly, travel along a leftwardly or rightwardly curved line or turn backwardly).

For example, if both of the right track 100R and the left track 100L are rotated at an equal speed in a forward direction, then the working machine 115 advances straightforwardly, but if the left track 100L is rotated at a higher speed than the right track 100R, then the working machine 115 advances along a leftwardly curved line. However, if the right track 100R is rotated at a higher speed than the left track 100L, then the working machine 115 advances along a rightwardly curved line, but if both of the right track 100R and the left track 100L are rotated at an equal speed in a reverse direction, then the working machine 115 can travel backwardly.

It is to be noted that the aforementioned revolving movement signifies a rotational movement of the working machine body section 102 by a revolving motor 110 which is hereinafter described with reference to FIG. 10.

By the way, the hydraulic control circuit apparatus 111 mentioned above includes, as shown in FIG. 10, hydraulic control valves 111-1 to 111-6 for transmitting control amounts to the hydraulic cylinder apparatus 105 to 107, traveling motors 109L and 109R and revolving motor 110, respectively.

The control valve 111-1 is switched by a pilot hydraulic pressure received from the right lever 101C via a pilot oil path 112-1 to control the hydraulic pressure of the boom driving hydraulic cylinder apparatus 105 via an oil path 113-1 to drive the boom driving hydraulic cylinder apparatus 105 to extend or contract to drive the boom 103.

Similarly, the control valve 111-2 is switched by a pilot hydraulic pressure received from the right lever 101C via a pilot oil path 112-2 to control the hydraulic pressure acting upon the hydraulic cylinder apparatus 107 via an oil path 113-2 to drive the hydraulic cylinder apparatus 107 to extend or contract to drive the bucket 108.

Meanwhile, the control valve 111-3 receives a pilot hydraulic pressure from the left pedal 101L via a pilot oil path 112-3 to control the hydraulic pressure at the left side traveling motor 109L through an oil path 113-3 to drive the left track 100L to rotate.

Similarly, the control valve 111-4 receives a pilot hydraulic pressure from the right pedal 101R via a pilot oil path 112-4 to control the hydraulic pressure at the right side traveling motor 109R via an oil path 113-4 to drive the right track 100R to rotate.

Further, the control valve 111-5 receives a pilot hydraulic pressure from the left lever 101B through a pilot oil path 112-5 to control the hydraulic pressure at the revolving motor 110 via an oil path 113-5 to drive the working machine body section 102 to rotate.

Meanwhile, the control valve 111-6 is switched by a pilot hydraulic pressure received from the left lever 101B via a pilot oil path 112-6 to control the hydraulic pressure acting upon the stick driving hydraulic cylinder apparatus 106 via an oil path 113-6 to drive the stick driving hydraulic cylinder apparatus 106 to extend or contract to drive the stick 104.

It is to be noted that the oil paths 113-1 to 113-6 described above are communicated with the hydraulic pump which is driven by the engine not shown and a reservoir tank via the hydraulic control valves 111-1 to 111-6, and also the pilot oil paths 112-1 to 112-6 are communicated with the hydraulic pump and the reservoir tank mentioned above.

By such a construction as described above, in order to operate the boom 13, the stick 104 or the bucket 108, the levers 101B and/or 101C as boom operating members, stick operating members or bucket operating members in the operator cab 101 are suitably manually operated forwardly or backwardly and leftwardly or rightwardly to cause a pilot hydraulic pressure to act upon the control valve 111-1, 111-6 or 111-2 via the pilot oil path 112-1, 112-6 or 112-2 to drive the boom driving hydraulic cylinder apparatus 105, the stick driving hydraulic cylinder apparatus 106 or the bucket driving hydraulic cylinder apparatus 107 to extend or contract.

Consequently, for example, if the boom driving hydraulic cylinder apparatus 105 is driven to extend or contract, then a boom raising operation (in a direction indicated by an arrow mark a) or a boom lowering operation (in a direction indicated by an arrow mark b) can be performed. Or, if the stick driving hydraulic cylinder apparatus 106 is driven to extend or contract, then a stick-out movement (in a direction indicated by an arrow mark c) or a stick-in movement (in a direction indicated by an arrow mark d) can be performed. Further, if the hydraulic cylinder apparatus 107 is driven to extend or contract, then a bucket dumping movement (opening movement, in a direction indicated by an arrow mark e) or a bucket curling operation (dragging-in movement, in a direction indicated by an arrow mark f) can be performed.

Accordingly, by using the working machine 115 and moving the end of a blade of the bucket 108 along a predetermined locus, various working operations such as, for example, excavation, loading or floor face finishing can be performed.

By the way, for example, in order to measure the accuracy of a floor face V at a location where excavating and floor face finishing operations have been performed by the working machine 115 described above with respect to an aimed floor face W by the hydraulic excavator itself as seen in FIG. 11, operating members such as the boom 103, stick 104 and bucket 108 are set at predetermined positions using a laser beam irradiated in parallel to the aimed floor face W from the outside of the construction machine.

In particular, an operator of the construction machine manually operates the levers 101B and/or 101C to drive the boom 103, stick 104 and bucket 108 so that the laser beam may be received at a predetermined angle (for example, at the right angle) by a laser receiver mounted on the working machine 115

Consequently, by setting, by manual operations, the boom 103, stick 104 and bucket 108 at such positions that the laser beam parallel to the aimed floor face W may be received at the predetermined angle by the laser receiver, the accuracy of the finished floor face can be measured.

However, when the accuracy of the floor face V at the location at which the working operation has been performed is measured by the hydraulic excavator itself using such a technique as described above, since the positions of the boom 103, stick 104 and bucket 108 are set while the operator visually observers the receiving angle of the laser beam at the laser receiver from within the operator cab 101, depending upon the mounted location of the laser receiver, it is difficult to visually observe whether or not the receiving angle of the laser beam at the laser receiver is accurately equal to the predetermined angle.

Accordingly, there is a subject that the boom 103, stick 104 and bucket 108 as the operating members cannot be accurately set at the positions mentioned above, and an error in measurement sometimes occurs also upon measurement of the accuracy of the finished floor face.

Further, the operator must manually operate the levers 101B and/or 101C as manually operable members to drive the three operating members of the boom 103, stick 104 and bucket 108, and there is another subject that a technique in manual operation for position setting for measurement is very difficult.

The present invention has been made in view of such subjects as described above, and it is an object of the present invention to provide a construction machine with a laser measuring instrument by which operating members can be driven so that a laser beam can be received at the right angle automatically and accurately.

DISCLOSURE OF THE INVENTION

To this end, a construction machine with a laser measuring instrument of the present invention which includes a construction machine body, a working apparatus provided on the construction machine body and including a plurality of arm members connected to each other like an arm for performing a desired working operation, an end working member mounted for pivotal motion on one of the arm members which is positioned on a free end side of the arm, and a cylinder apparatus for driving the arm members and the end working member, and a manually operable member for driving the cylinder apparatus of the working apparatus to operate the plurality of arm members and end working member, is characterized in that it comprises an array type laser receiver mounted on the arm member positioned on the free end side of the arm for receiving a laser beam parallel to an aimed floor face irradiated from a laser apparatus disposed at a position spaced away from the construction machine, posture detection means for detecting a posture of the construction machine, and control means for controlling the working apparatus based on a result of detection by the posture detection means so that the array type laser receiver may receive the laser beam from the laser apparatus at a predetermined angle.

Further, the construction machine with a laser measuring instrument may be constructed such that the posture detection means includes an inclination angle sensor for detecting an inclination angle of the construction machine body, and a plurality of angle sensors for detecting angles of the plurality of arm members and end working member.

Furthermore, the construction machine with a laser measuring instrument may be constructed such that the control means includes a setting unit in which an installation condition of the laser apparatus is set, a posture calculation section for calculating, based on the installation condition of the laser apparatus set by the setting unit and the result of detection by the posture detection means, a posture of the construction machine with which the array type laser receiver can receive the laser beam from the laser apparatus at the predetermined angle, and a control section for controlling the working apparatus in response to a manual operation of the manually operable member which operates a particular one of the arm members so that the construction machine may have the posture calculated by the posture calculation section.

In this instance, the posture calculation section may be constructed such that it calibrates a difference between an installation height of the laser apparatus and a height of a laser light receiving point in a condition wherein the end working member contacts with the floor face to calculate the posture of the construction machine Meanwhile, another construction machine with a laser measuring instrument of the present invention which includes a construction machine body, a working apparatus provided on the construction machine body and including a plurality of working members for performing a desired operation, and a working apparatus operating member for operating the plurality of working members of the working apparatus, is characterized in that it comprises an array type laser receiver mounted on the working apparatus for receiving a laser beam parallel to an aimed floor face irradiated from a laser apparatus disposed at a position spaced away from the construction machine, posture detection means for detecting a posture of the construction machine, and control means for controlling the working apparatus based on a result of detection by the posture detection means so that the array type laser receiver may receive the laser beam from the laser apparatus at a predetermined angle.

Accordingly, with the construction machines with a laser measuring instrument of the present invention, since the control means can control the working apparatus automatically and accurately based on a result of detection from the posture detection means so that the array type laser receiver can receive the laser beam from the laser apparatus at the right angle, there is an advantage that, while facilitating manual operations of an operator, measurement of a finished floor can be performed with a high degree of accuracy without being influenced by an inclination of the construction machine body.

Further, since the posture calculation section calibrates the difference between the installation height of the laser apparatus and the height of the laser light receiving point in a condition wherein the end working member contacts with the floor face to calculate the posture of the construction machine, measurement of the position of the blade end of the bucket can be performed using only detection information from the posture detection means, and also there is an advantage that measurement is facilitated very much.

BEST MODE FOR CARRYING OUT THE INVENTION

Figure 1:
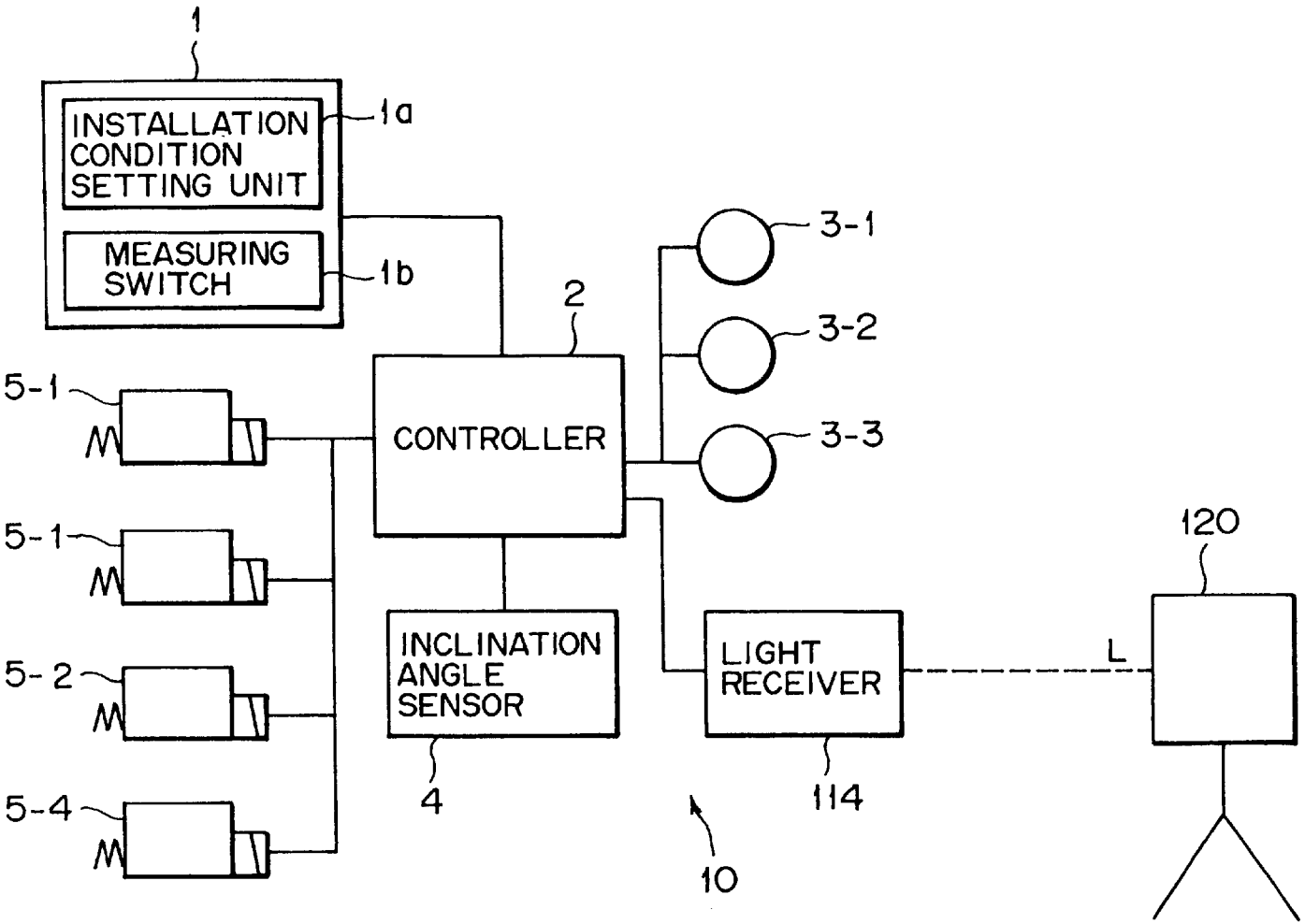
FIG. 1 is a block diagram illustrating functions of a construction machine with a laser measuring instrument according to an embodiment.
Figure 2:
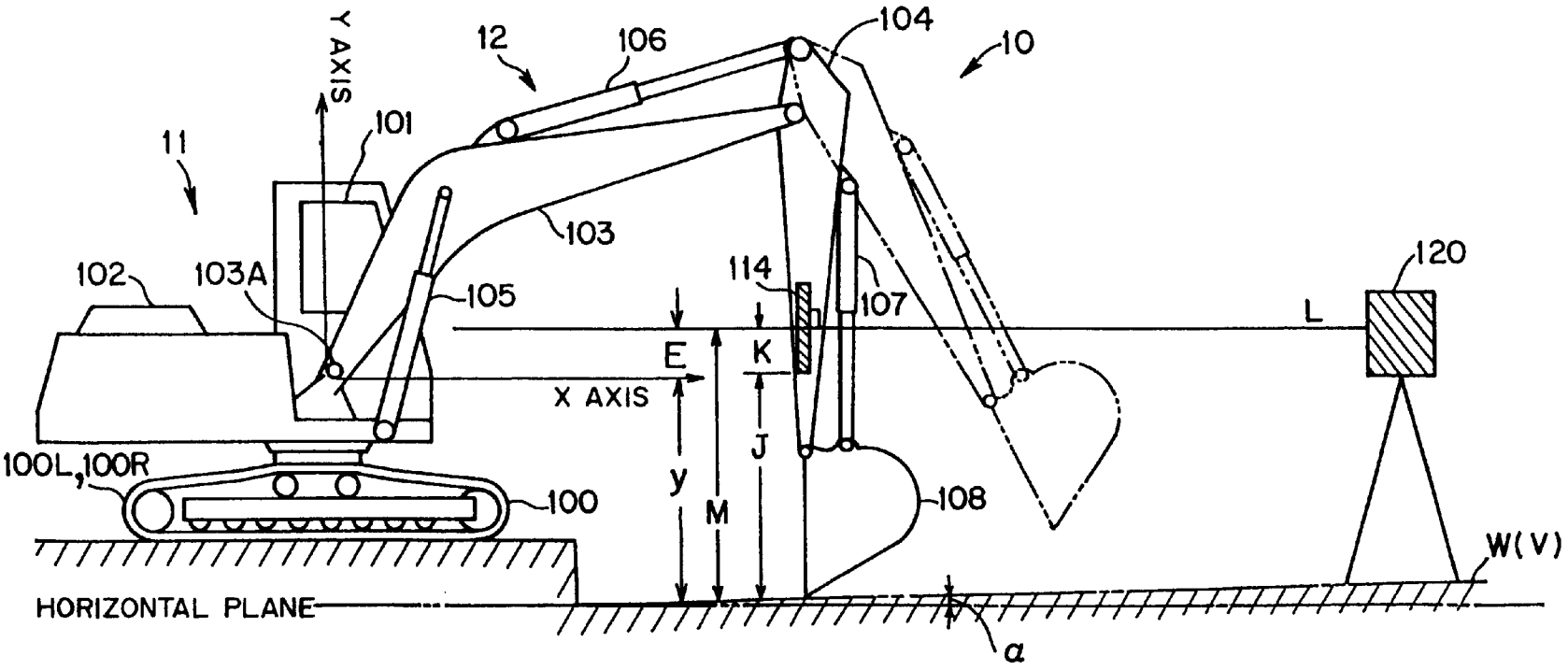
FIGS. 2 and 3 are schematic side elevational views showing appearances of the construction machine with a laser measuring instrument according to the present embodiment.
Figure 3:
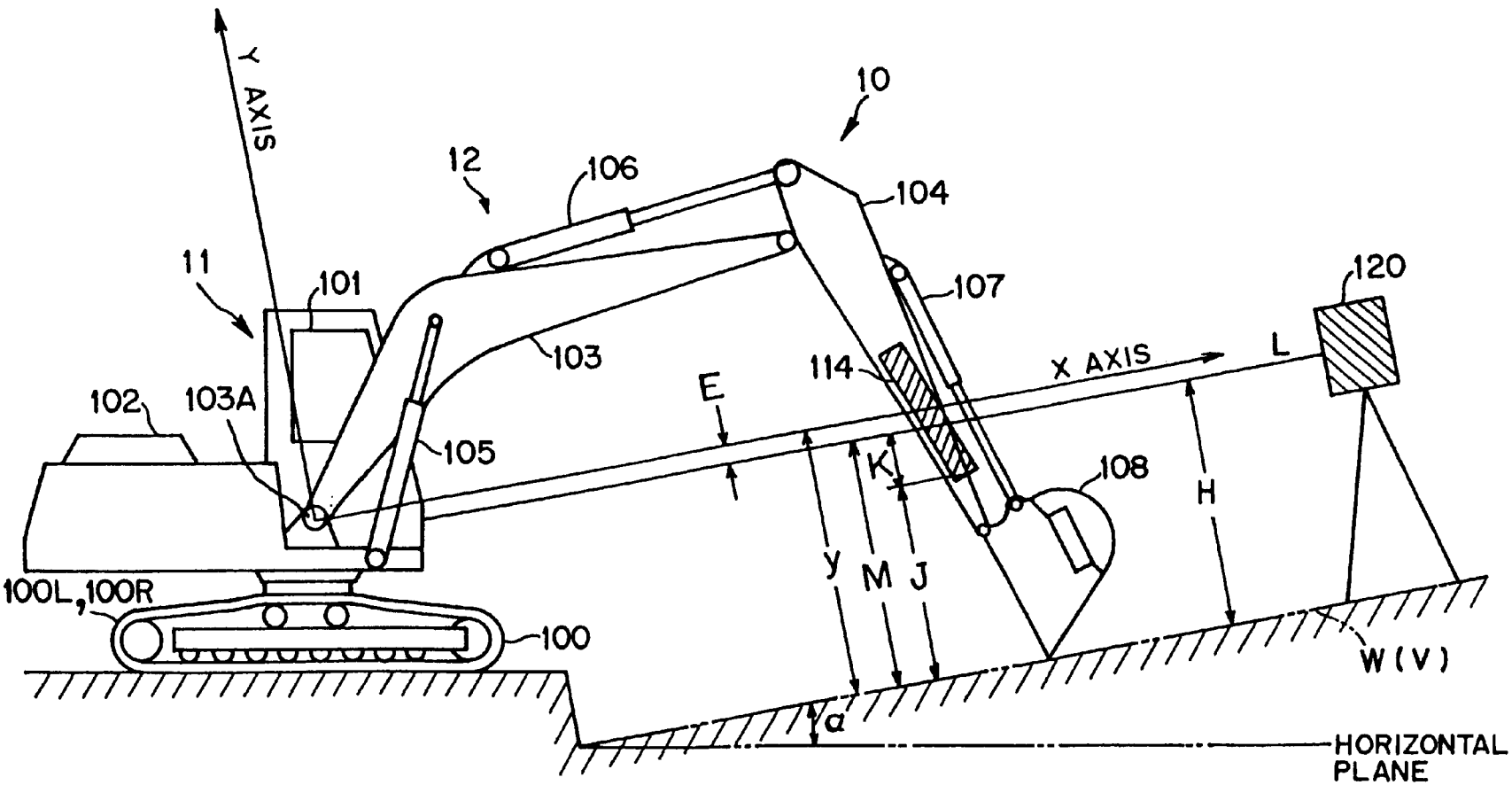
Figure 4:
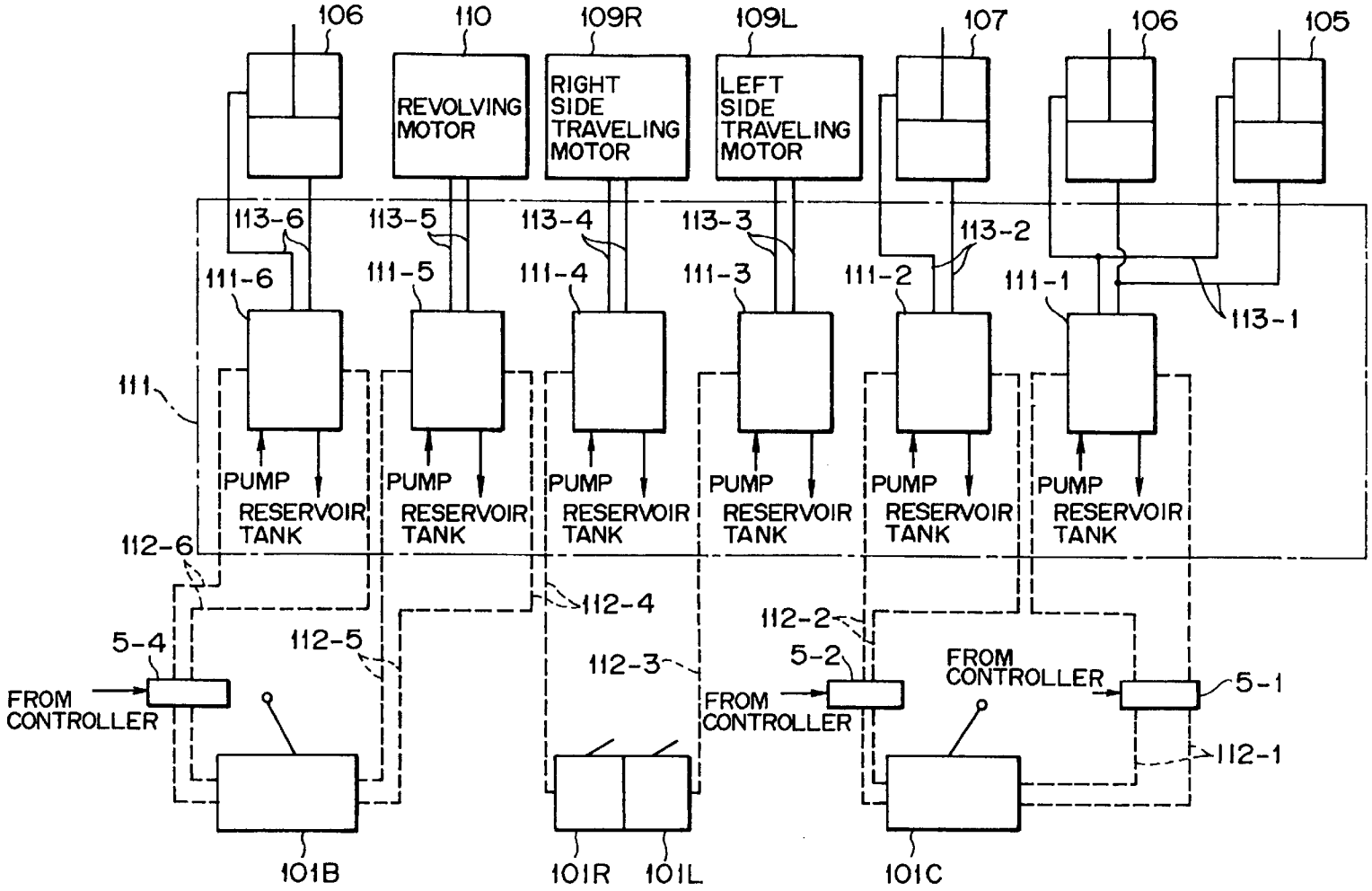
FIG. 4 is a view showing a hydraulic control circuit apparatus employed in the construction machine with a laser measuring instrument according to the present embodiment.
Figure 5:
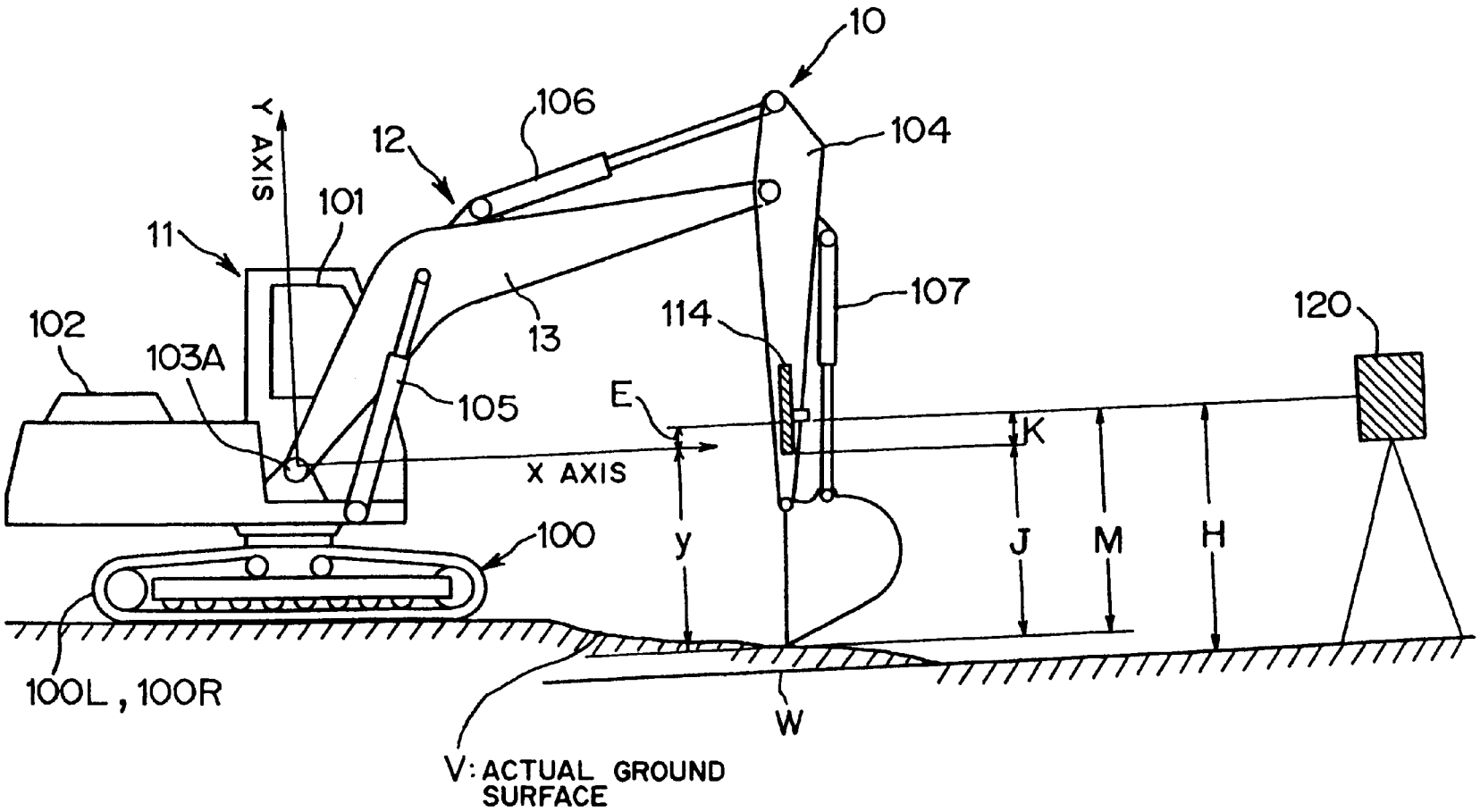
FIG. 5 is a schematic side elevational view illustrating operation of the construction machine with a laser measuring instrument according to the present embodiment.
Figure 6:
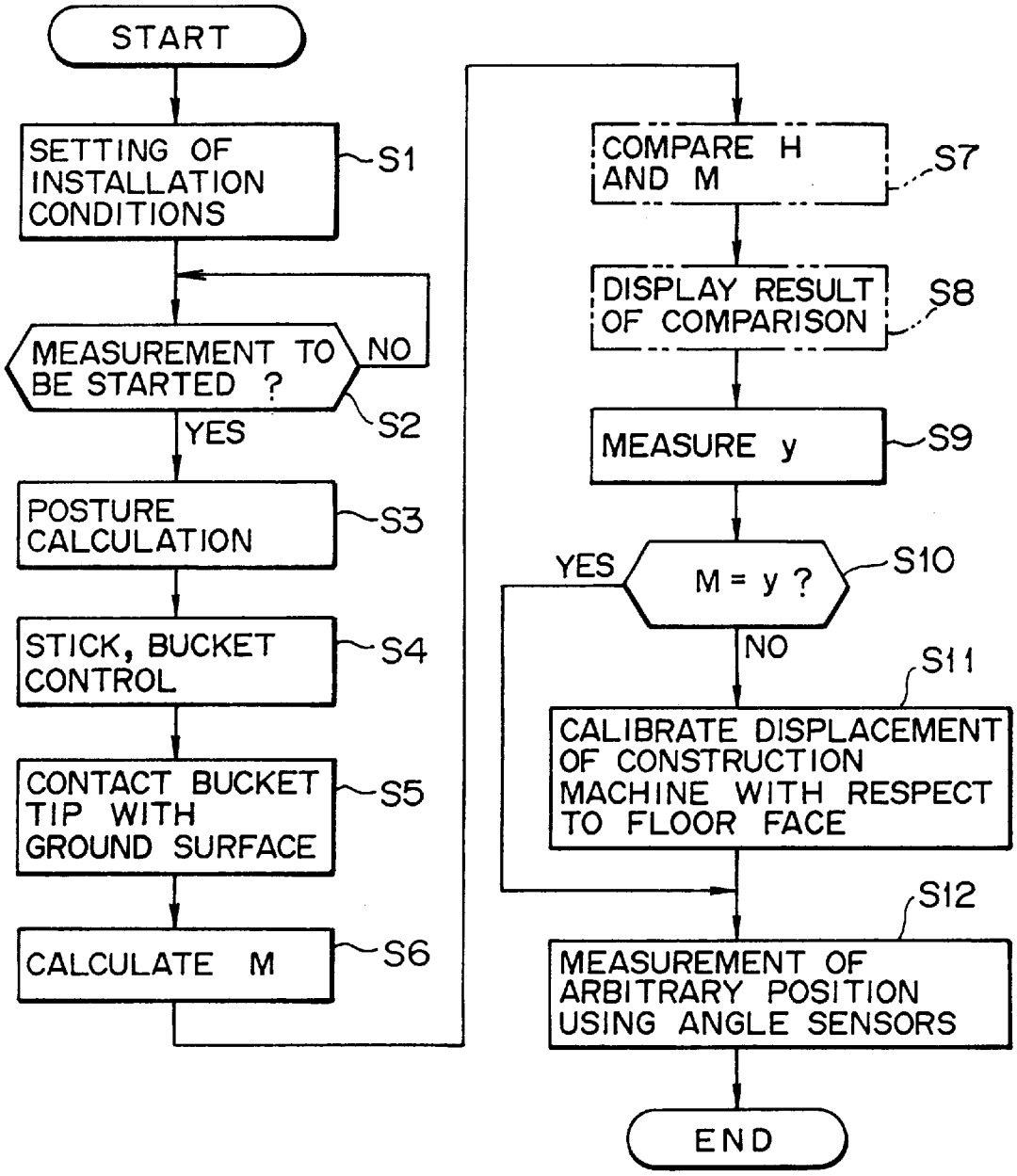
FIG. 6 is a flow chart illustrating operation of the construction machine with a laser measuring instrument according to the present embodiment.
Figure 7:
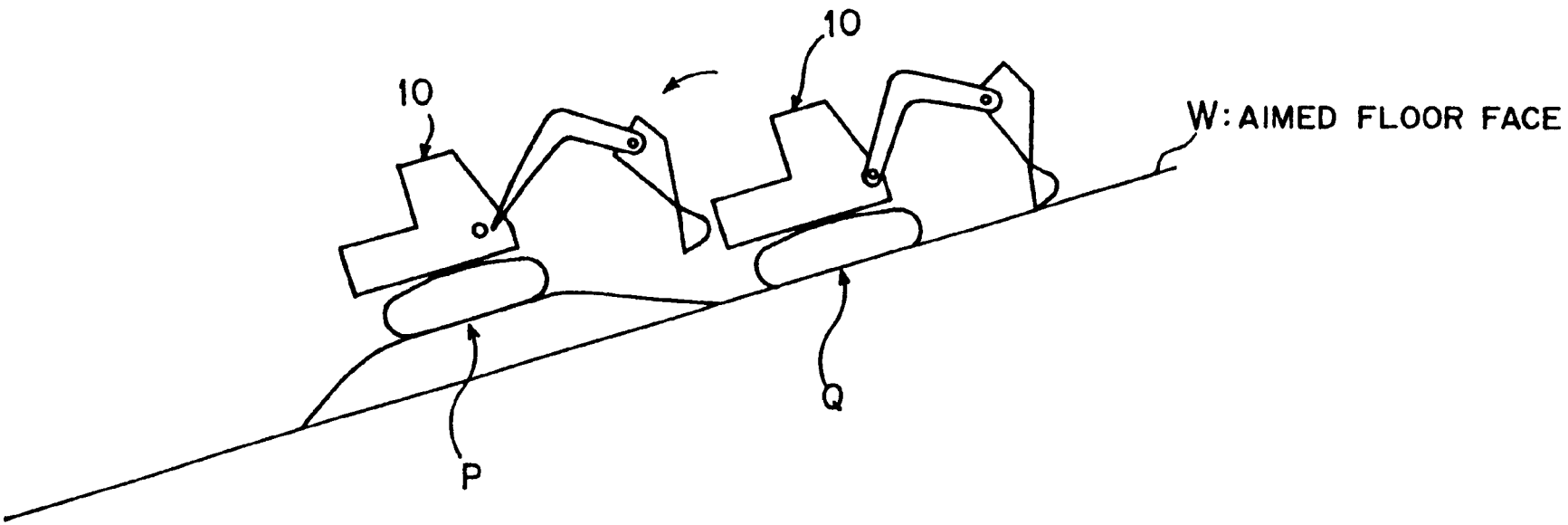
FIG. 7 is a view illustrating actions and effects of the construction machine with a laser measuring instrument according to the present embodiment.

In the following, an embodiment of the present invention is described with reference to the drawings. FIGS. 1 to 7 show a construction machine with a laser measuring instrument according to an embodiment of the present invention, and FIG. 1 is a block diagram illustrating functions of the construction machine with a laser measuring instrument according to the present embodiment, FIGS. 2, 3 and 5 are schematic side elevational views showing appearances of the construction machine with a laser measuring instrument according to the present embodiment, FIG. 4 is a view showing a hydraulic control circuit apparatus employed in the construction machine with a laser measuring instrument according to the present embodiment, FIG. 6 is a flow chart illustrating operation of the construction machine with a laser measuring instrument according to the present embodiment, and FIG. 7 is a view illustrating actions and effects of the construction machine with a laser measuring instrument according to the present embodiment.

Figure 8:
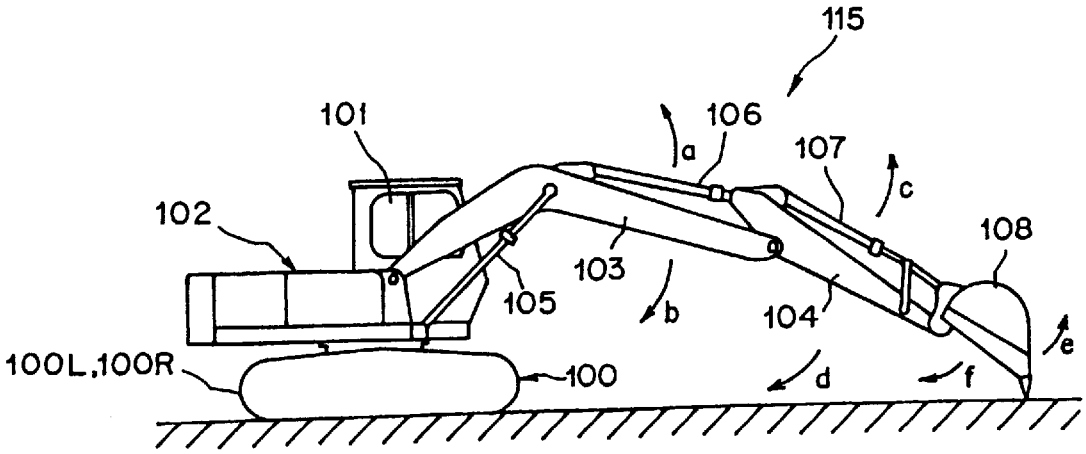
FIG. 8 is a schematic side elevational view showing a construction machine such as a hydraulic excavator.

The construction machine with a laser measuring instrument according to the present embodiment has a basic construction basically similar to that described hereinabove with reference to FIG. 8. It is to be noted that same reference symbols in FIGS. 1 to 7 as those in FIGS. 8 to 10 denote similar elements.

In particular, also the construction machine 10 with a laser measuring instrument according to the present embodiment includes, as shown in FIGS. 2 and 3, a construction machine body 11 including a lower traveling member 100 as a traveling section having tracks 100L and 100R and a working machine body section 102 as an upper body member provided on the lower traveling member 100, a boom 103 and a stick 104 as an arm member provided on the construction machine body 11, a bucket 108 as an end working member mounted for pivotal motion on the stick 104, and cylinder apparatus 105 to 107 for driving the boom 103, stick 104 and bucket 108 mentioned above.

Accordingly, a working apparatus 12 is formed from the construction machine body 11, boom 103, stick 104, bucket 108 and cylinder apparatus 105 to 107 mentioned above.

Figure 9:
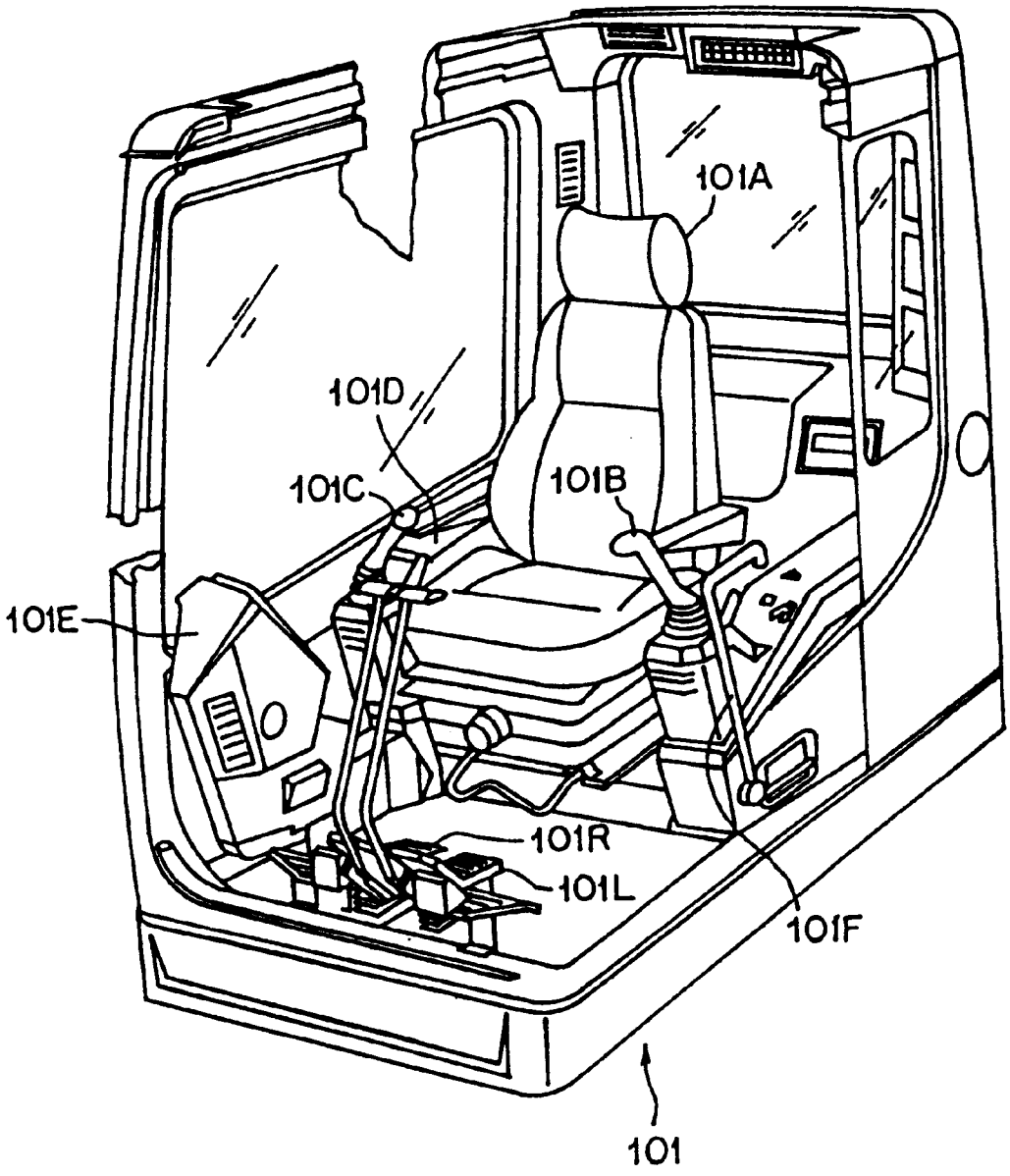
FIG. 9 is a schematic perspective view, partly in section, showing an operator cab of a construction machine such as a hydraulic excavator.
Figure 10:
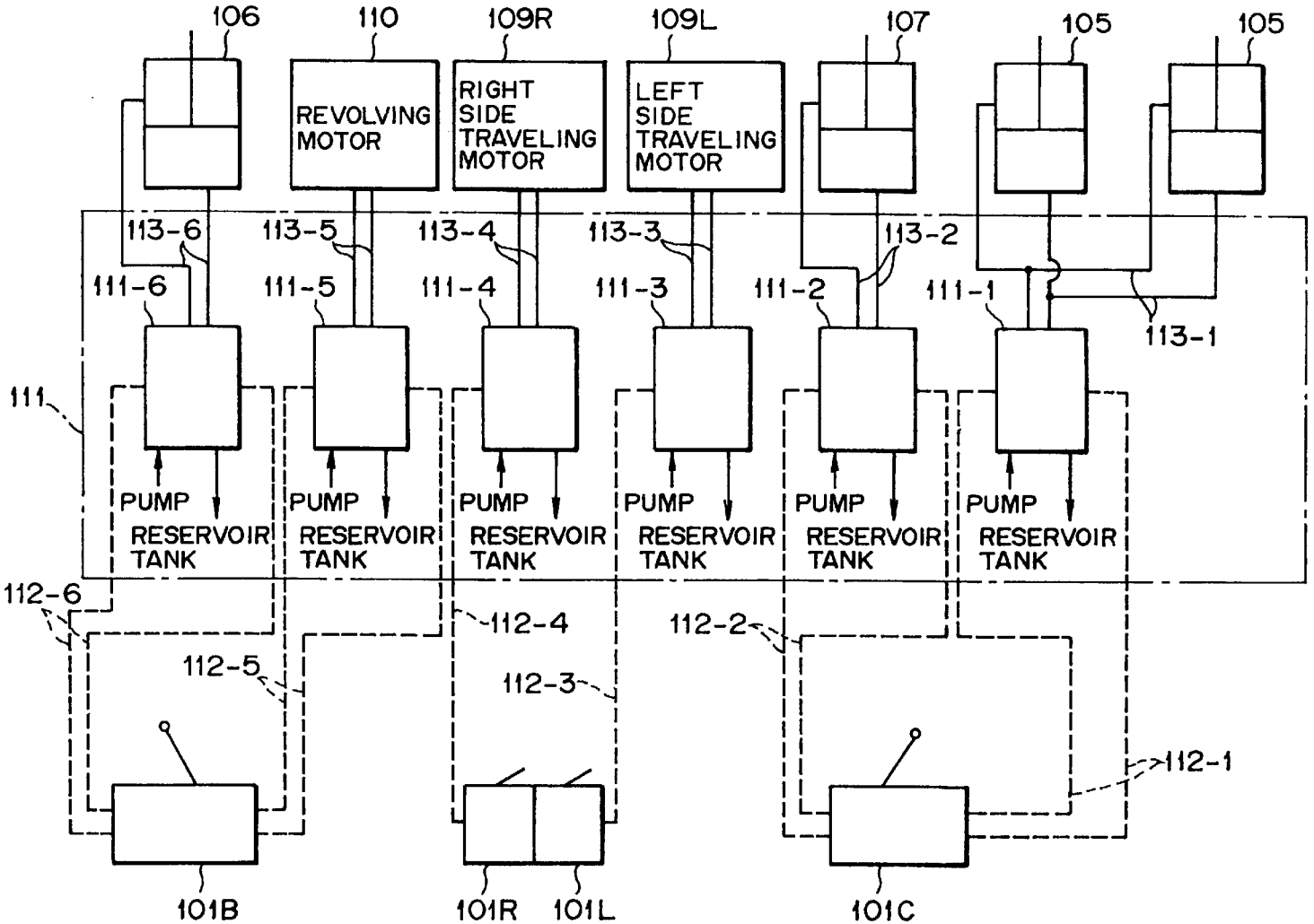
FIG. 10 is a view illustrating a hydraulic control circuit apparatus for use with a construction machine such as a hydraulic excavator.
Figure 11:
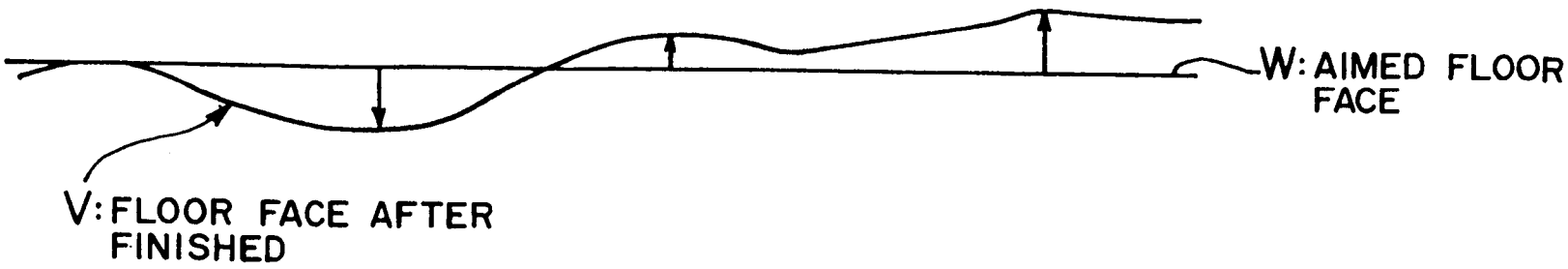
FIG. 11 is a view schematically illustrating an accuracy of a floor face at a location at which a working operation has been performed with respect to an aimed floor face.

Further, the construction machine 10 shown in FIGS. 2, 3 and 5 includes, as described hereinabove with reference to FIG. 9, levers 101B and 10C as manually operable members for operating the boom 103, stick 104 and bucket 108 by driving the cylinder apparatus 105 to 107 of the working apparatus 12.

The boom 103 and the stick 104 as an arm member are provided on the construction machine body 11 and connected to each other like an arm so as to perform a desired working operation, and the bucket 108 as an end working member is mounted for pivotal motion on the stick 104 as an arm member positioned on the free end side.

The stick 104 has, similarly to that described hereinabove with reference to FIG. 8, a light receiver 114 mounted thereon in such a manner as to receive a laser beam L irradiated in parallel to an aimed floor face W from a laser transmitter (laser apparatus) 120 as a laser apparatus disposed at a position spaced away from the construction machine 10. It is to be noted that the light receiver 114 is formed from an array type laser receiver wherein a plurality of light receiving elements are arranged in an array Further, Further, while the construction machine according to the present embodiment includes pilot pressure control valves 5-1, 5-2 and 5-4 as solenoid valves for controlling operations of the boom 103, stick 104, bucket 108 and so forth, a control system for controlling pilot pressures for the pilot pressure control valves 5-1, 5-2 and 5-4 has such a construction as shown, for example, in FIG. 1.

Here, reference numeral 1 denotes a setting section, and this setting section 1 includes an installation condition setting unit (setting unit) 1*a* for setting installation conditions of the laser transmitter 120 when, for example, the accuracy of a finished floor face is to be measured, and further includes a measuring switch 1*b* for starting actual measurement. The aimed angle setting unit 1*a* is provided, for example, on an instrument panel 101E in the operator cab 101 while the measuring switch 1*b* can be provided, for example, on one of the manually operable levers 101B and 101C.

Particularly, the aimed angle setting unit 1*a* described above sets the angle of the aimed floor face as an angle of the laser beam L irradiated from the laser transmitter 120 and the installation height of the laser transmitter 120 as installation conditions.

Furthermore, reference symbols 3-1 to 3-3 denote each an angle sensor, and the angle sensor 3-1 detects the angle of the boom 103 with respect to the working machine body section 102 based on a driving condition of the boom driving hydraulic cylinder apparatus 105. The angle sensor 3-2 detects an angle of the stick 104 with respect to the boom 103 based on a driving condition of the stick driving hydraulic cylinder apparatus 106. The angle sensor 3-3 detects an angle of the bucket 108 with respect to the stick 104 based on a driving condition of the hydraulic cylinder apparatus 107.

Meanwhile, reference numeral 4 denotes an inclination angle sensor, and this inclination angle sensor 4 detects an inclination of the construction machine 10 itself, that is, an inclination angle of the construction machine body 11 with respect to the horizontal plane, and the inclination angle sensor 4 and the angle sensors 3-1 to 3-3 described above function as posture detection means for detecting the posture of the construction machine 10.

A controller 2 controls driving of the working apparatus 12 based on angle detection information from the angle sensors 3-1 to 3-3, an inclination of the construction machine 10 itself detected by the inclination angle sensor 4 and angle information of the aimed floor face from the setting section 1 so that the array type laser receiver 114 can receive the laser beam L from the laser transmitter 120 at a predetermined angle (for example, at the right angle), and the controller 2 and the setting section 1 described above function as control means.

In other words, the controller 2 calculates, based on the detection information of the sensors described above, angles of the boom 103, stick 104 and bucket 108 with which the array type laser receiver 114 can receive the laser beam L from the laser transmitter 120 at the right angle, and controls the pilot pressure control valves 5-1, 5-2 and 5-4 so that the calculated angles of the boom 103, stick 104 and bucket 108 may be reached.

It is to be noted that, in this instance, the boom 103 is driven in response to a manual operation of the operator side, and the controller 2 can calculate angles of the stick 104 and the bucket 108 to be controlled in response to the driven condition of the boom 103 and control the pilot pressure control valves 5-1, 5-2 and 5-3 based on a result of the calculation.

In particular, the controller 2 has a function as a posture calculation section for calculating, based on the installation conditions of the laser transmitter 120 set by the installation condition setting unit 1*a* and the result of detection by the sensors 3-1 to 3-3 and 4 described above, a posture of the construction machine 10 with which the array type laser receiver 114 can receive the laser beam from the laser transmitter 120 at the right angle and has another function as a control section for controlling the stick 104 and the bucket 108 in response to a manual operation of the lever 101B, which operates the boom 103 as a particular arm member, so that the construction machine 10 may have the posture calculated by the controller 2.

It is to be noted that the construction machine shown in FIG. 2 shows a case wherein the working apparatus 12 is controlled to be driven so that the array type laser receiver 114 may receive the laser beam L from the laser transmitter 120 at the right angle, and the construction machine in FIG. 3 shows another case wherein the working apparatus 12 is controlled to be driven so that the array type laser receiver 114 may receive the laser beam L from the laser transmitter 120 at an angle other than the right angle.

Meanwhile, the pilot pressure control valves 5-1, 5-2 and 5-4 are interposed in pilot oil paths 112-1, 112-2, 112-5 and 112-6 as shown in FIG. 4, respectively, and control pilot hydraulic pressures to be supplied to hydraulic control valves 111-1, 111-2, 111-5 and 111-6 in accordance with control information from the controller 2. Consequently, the boom 103, stick 104 and bucket 108 are controlled to be driven in response to control signals from the controller 2.

It is to be noted that, in FIG. 2, reference symbol 103A denotes a boom foot pin which connects the boom 103 for pivotal motion to the construction machine body 11, and the posture of the construction machine 10 can be calculated from angle detection information from the angle sensors 3-1 to 3-3 with respect to an origin provided by the position of the boom foot pin 103A.

In the construction machine with a laser measuring instrument according to the embodiment of the present invention having the construction described above, if an excavating or floor face finishing operation (slope face shaping operation) is performed by the construction machine 10, then the construction machine 10 can measure an accuracy of a floor face a(ground surface) V at a location for which the working operation has been performed with respect to the aimed floor face W.

Here, it is assumed that the laser transmitter 120 is set so that it may irradiate the laser beam L parallel to the angle $\alpha$ of an aimed floor face at the height H from the aimed floor face.

First, an operator of the construction machine 10 sets, prior to measurement of the floor face finishing accuracy mentioned above, the distance H between the ground surface and the laser together with the angle $\alpha$ mentioned above as an installation condition of the laser transmitter 120 to the controller 2 via the installation condition setting unit 1*a* (step S1).

Here, when measurement of the finished floor face is to be started, the operator manually operates the switch 1*b*. When the controller 2 receives, from the switch 1*b* described above, a signal representing that measurement should be started (YES route of step S2), the controller 2 receives angle detection information of the boom 103, stick 104 and bucket 108 from the three angle sensors 3-1 to 3-3 and body inclination angle detection information from the inclination angle sensor 4 and detects the posture of the construction machine 10 at present from the detection information (step S3).

The controller 2 calculates, based on the posture of the construction machine 10 at present detected as described above and the angle $\alpha$ from the above-described setting section 1*a*, postures of the stick 104 and the bucket 108 with which the laser beam L from the laser transmitter 120 may be incident at the right angle to the array type laser receiver 114 and controls the pilot pressure control valves 5-2 and 5-4 so that the stick 104 and the bucket 108 may have the thus calculated postures (step S4).

In particular, if the pilot pressures are controlled by the pilot pressure control valves 5-2 and 5-4, then the stick driving hydraulic cylinder apparatus 106 and the bucket driving hydraulic cylinder apparatus 107 are driven under the control the hydraulic control circuit apparatus 111 so that the stick 104 and the bucket 108 are positioned to the postures described above.

After the stick 104 and the bucket 108 are driven so that the array type laser receiver 114 may receive the laser beam L at the right angle in this manner, the operator manually operates the lever 100C to drive the boom 103 so that the bucket blade end (bucket tip) may be contacted with a point for measurement.

In this instance, the controller 2 controls the stick 104 and the bucket 108 to be driven in response to a movement of the boom 103 so that the angle formed by the array type laser receiver 114 and the incident laser beam L may maintain the right angle (step S5).

In other words, the operator can set the position of the working apparatus 12 only by an upward or downward movement of the boom 103 via the lever 101C so that the laser beam L may be received accurately by the array type laser receiver 114.

Thereafter, if the bucket tip is adjusted to (contacted with) the point for measurement by a manual operation by the operator, then the array type laser receiver 114 transfers position information of the light receiving point (height information K from the lower end of the array type laser receiver 114; refer to FIG. 2) to the controller 2.

The controller 2 adds the position information of the light receiving point and length information J from the bucket tip to the lower end of the array type laser receiver 114 (refer to FIG. 2) to calculate the height M of the laser light receiving point from the actual position of the ground surface with which the bucket tip is contacted (step S6).

The controller 2 compares the thus calculated value M with the height H of the laser beam L from the aimed floor face set by the installation condition setting unit la in advance (step S7), and displays the difference between the heights M and H mentioned above as a comparison result on the instrument panel 101E and can determine the difference as a measurement result of the accuracy of the finished floor face (step S8).

Thereafter, the height y from the bucket tip contacting point to the boom foot position in a condition wherein the construction machine 10 is in an arbitrary posture is measured based on the angle detection information from the angle sensors 3-1 to 3-3 and length information of the boom 103, stick 104 and bucket 108 inputted in advance as seen in FIG. 2, 3 or 5 (step S9).

In particular, by using this value y, a value equivalent to the value M which makes a reference for comparison when the accuracy of the finished floor face is measured in a condition wherein the construction machine 10 is in an arbitrary posture can be calculated, and the accuracy of the finished floor face can be measured through comparison of this value equivalent to M and H described above.

In this instance, when the height M from the bucket tip contacting point to the laser light receiving point when the blade end (bucket tip) of the bucket 108 is contacted with the actual floor face in a condition wherein the laser beam L is received at the right angle by the laser receiver 114 and the height y from the bucket tip contacting point to the boom foot position calculated from the angle detection information from the angle sensors 3-1 to 3-3 at the point of time are different from each other, the controller 2 calculates the difference E=M−y between them (from the NO route of step S10 to step S11).

By using this value E, the origin when the accuracy of the finished floor face is to be measured can be calibrated from the boom foot position to the laser light receiving position. In other words, the value y+E obtained by adding the value E mentioned above to y calculated from the angle detection information from the angle sensors 3-1 to 3-3 in a condition wherein the construction machine 10 is in an arbitrary posture can be determined as the height (value equivalent to M mentioned above) from the bucket tip contacting point to the height of the laser light receiving position.

In other words, the controller 2 can calibrate the difference E between the height M from the bucket contacting point to the laser light receiving point and the height y from the bucket tip contacting point to the boom foot position calculated from the angle detection information from the angle sensors 3-1 to 3-3 in a condition wherein the blade end (bucket tip) of the bucket 108 actually contacts with the actual floor face while the laser beam L is being received at the right angle by the laser receiver 114 to calculate the posture of the construction machine 10.

In particular, as seen in FIG. 5, the controller 2 can calculate the difference E between the height y from the origin provided by the position of the boom foot pin 103A to the bucket tip contacted with the ground surface and the height M from the laser light receiving point to the bucket tip and calibrate the origin for posture calculation of the construction machine 10 described above by using this value E (step S11).

When the origin for posture calculation is calibrated in this manner or the values M and y mentioned above are equal to each other (YES route of step S10), by detecting the postures of the boom 103, stick 104 and bucket 108 based on the angle detection information from the angle sensors 3-1 to 3-3 and the inclination angle sensor 4 without measuring the light receiving position of the laser beam L, the accuracy of an arbitrary position on the finished floor face can be measured (step S12).

In particular, the accuracy of the finished floor face can be measured by comparing the value y+E obtained by adding the value E mentioned above to the height y from the bucket tip contacting point to the boom foot position and the reference height H from the aimed floor face based on the information from the angle sensors 3-1 to 3-3 in a condition wherein the bucket tip is contacted with the ground surface at an arbitrary position on the finished floor face with each other to discriminate whether or not the finished floor face is finished at the same level with the aimed floor face.

In other words, since the posture of the construction machine 10 can be detected only from the angle detection information from the angle sensors 3-1 to 3-3 described above, even if the array type laser receiver 114 does not receive the laser beam L at the right angle, the value y+E equivalent to the height M from the bucket tip to the laser light receiving point can be calculated, and consequently, measurement using the laser beam L (measurement of the position of the bucket tip) can be performed in an arbitrary posture of the construction machine 10 by performing calibration of the displacement from the floor face of the construction machine 10 (calibration of the origin for posture calculation) can be performed.

It is to be noted that, if the construction machine 10 moves after calibration of the origin for posture calculation is performed, then in order to effect measurement of the finished ground floor at the position after the movement, such calibration of the position of the origin as described above must be performed again.

In particular, for example, if the construction machine 10 first performs measurement at a position Q and then moves to another position P as seen in FIG. 7 and tries to effect measurement, then since the positional relationship between the aimed floor face and the construction machine 10 changes, measurement of the position of the bucket tip cannot be performed only with the angle detection information from the angle sensors 3-1 to 3-3.

In this instance, after the construction machine 10 moves, the accuracy of the finished floor face can be measured readily by performing calibration of the origin for posture calculation described above in accordance with the necessity after the position of the working apparatus 12 with which the laser beam L enters the array type laser receiver 114 at the right angle is set using the laser beam L from the laser transmitter 120.

It is to be noted that, where measurement of the accuracy of the finished floor face using the angle detection information from the angle sensors 3-1 to 3-3 described above is performed principally, the measurement of the finished floor face using the laser receiver 114 (steps S7 and S8) can be omitted suitably.

In this manner, with the construction machine with a laser measuring machine according the embodiment of the present invention, since the controller 2 can control the working apparatus 12 automatically and accurately based on a result of detection from the angle sensors 3-1 to 3-3 and the inclination angle sensor 4 so that the array type laser receiver 114 may receive the laser beam L from the laser transmitter 120 at the right angle, there is an advantage that, while facilitating manual operations of an operator (only upward or downward movement of the boom 103), measurement of the finished floor face (measurement of the position of the bucket tip) can be performed with a high degree of accuracy without being influenced by the inclination of the construction machine body 11.

Further, since the controller 2 calibrates the difference between the installation height H of the laser transmitter 120 and the height M of the laser light receiving point in a condition wherein the bucket 108 contacts with the floor face to calculate the posture of the construction machine 10, measurement of the position of the blade end of the bucket can be performed using only the detection information from the angle sensors 3-1 to 3-3, and there is another advantage that measurement is facilitated remarkably.

It is to be noted that, while, in the embodiment described above, the array type laser receiver 114 is mounted on the stick 104, the mounted position of the array type laser receiver 114 is not limited to this, and the array type laser receiver 114 may be mounted at an arbitrary position on the boom 103, stick 104 or bucket 108 as the working apparatus 12.

Further, while, in the embodiment described above, a case wherein a hydraulic excavator is applied L as the construction machine 10 is described in detail, it is a matter of course that the present invention can be applied to any other construction machine than this.

Furthermore, while, in the present embodiment, the controller 2 controls the boom 103, stick 104 and bucket 108 so that the laser beam L may be received at the right angle by the laser receiver 114, the control is not limited to this, and the boom 103, stick 104 and bucket 108 may be controlled so that the laser beam L may be received at an angle other than the right angle by the laser receiver 114.

In this instance, when measurement of the position of the blade end of the bucket is performed based on the angle detection information from the angle sensors 3-1 to 3-3, a trigonometric function may be used suitably to effect measurement of a finished floor face similar to that in the case of the present embodiment described above.

INDUSTRIAL APPLICABILITY OF THE INVENTION

Where the present invention is used when measurement of a finished floor face is to be performed, since a working apparatus can be controlled automatically and accurately so that an array type laser receiver may receive a laser beam from a laser apparatus at the right angle, measurement of the finished floor face can be performed with a high degree of accuracy without being influenced by an inclination of the body of the construction machine while facilitating manual operations of an operator. Accordingly, the present invention contributes to improvement in accuracy in measurement of such a finished floor face, and it is considered that the utility of the present invention is very high.

What is claimed is:

1. A method for measuring the finishing accuracy of a floor face which is smoothed by a construction machine, said construction machine including a machine body and a working apparatus mounted on the machine body and including a plurality of arm members pivotally connected end to end for performing a desired working operation, an end working member pivotally connected to a distal-end arm member, and driving apparatus for driving the arm members and the end working member, said method comprising:

(a) detecting angles of the arm members and the end working member with respect to the machine body, and detecting an angle of the machine body with respect to a reference plane or line;

(b) calculating an angle of one of the arm members, which pivotally supports the end working member, with respect to the reference plane or line based on information of the angles detected in said step (a):

(c) controlling the posture of each of the arm members in such a manner that the angle of the individual arm member, which has been calculated in said step (b), is maintained at a predetermined angle, and bringing the lower end of the end working member into a contact with the floor face smoothed by the construction machine;

(d) receiving, with the condition obtained in said step (c) being maintained, the laser beam irradiated from a laser apparatus disposed at a fixed position remote from the construction machine, by an array type laser receiver mounted on the distal-end arm member; and (e) determining a degree of the finishing accuracy of the smoothed floor face by comparing the height of the smoothed floor face with a predetermined target floor height based on information on where said laser beam has been received in said array type laser receiver.

2. An apparatus for measuring the finishing accuracy of a floor face, which is smoothed by a construction machine, said construction machine including a machine body, and a working apparatus mounted on the machine body and including a plurality of arm members pivotally connected end to end for performing a desired working operation, an end working member pivotally connected to a distal-end arm member, and a driving apparatus for driving the arm members and the end working member, said apparatus for measuring the finishing accuracy of a floor face comprising:

detecting means for detecting angles of the arm members and the end working member with respect to the machine body, and detecting an angle of the machine body with respect to a reference plane or line;

calculating means for calculating an angle of one of the arm members, which pivotally supports the end working member, with respect to the reference plane or line based on information of the angles detected by said detecting means;

controlling means for controlling the posture of each of the arm members in such a manner that the angle of the individual arm member, which as been calculated by said calculating means, is maintained at a predetermined angle, and bringing the lower end of the end working member into a contact with the floor face smoothed by the construction machine;

receiving means for receiving, with the condition obtained by said controlling means being maintained, the laser beam irradiated from a laser apparatus disposed at a fixed position remote from the construction machine, by an array type laser receiver mounted on the distal-end arm member; and determining means for determining a degree of the finishing accuracy of the smoothed floor face by comparing the height of the smoothed floor face with a predetermined target floor height based on information on where said laser beam has been received in said array type laser receiver.

* * * * *